US005494706A

United States Patent [19]

Abe et al.

[11] Patent Number: 5,494,706

[45] Date of Patent: Feb. 27, 1996

[54] METHOD FOR PRODUCING ZINC COATED STEEL SHEET

[75] Inventors: Masaki Abe; Satoru Ando; Toyofumi Watanabe; Yukimitsu Shiohara, all of Kawasaki, Japan

[73] Assignee: NKK Corporation, Tokyo, Japan

[21] Appl. No.: 263,088

[22] Filed: Jun. 21, 1994

[30] Foreign Application Priority Data

| | | | |
|---|---|---|---|
| Jun. 29, 1993 | [JP] | Japan | 5-158502 |
| Jun. 29, 1993 | [JP] | Japan | 5-158503 |
| Sep. 2, 1993 | [JP] | Japan | 5-218565 |
| Dec. 13, 1993 | [JP] | Japan | 5-311937 |

[51] Int. Cl.[6] ..... C25D 15/02

[52] U.S. Cl. ..... 427/329; 427/406; 427/433

[58] Field of Search ..... 427/329, 406, 427/433, 305; 205/228

[56] References Cited

FOREIGN PATENT DOCUMENTS

| | | |
|---|---|---|
| 2554831 | 5/1985 | France . |
| 54-75421 | 6/1979 | Japan . |
| 56-9356 | 1/1981 | Japan . |
| 57-171692 | 10/1982 | Japan . |
| 59-170288 | 9/1984 | Japan . |
| 61-60914 | 12/1986 | Japan . |
| 62-139860 | 6/1987 | Japan . |
| 3-24255 | 2/1991 | Japan . |

OTHER PUBLICATIONS

Patent Abstracts of Japan, vol. 10, No. 314 (C–380) 24 Oct. 1986 of JP–A–61 124 580 (Nippon Steel Corp.) 12 Jun. 1986.

Patent Abstracts of Japan, vol. 13, No. 156 (C–585) 14 Apr. 1989 of JP–A–63 312 960 (Nippon Steel Corp) 21 Dec. 1988.

Patent Abstracts of Japan, vol. 15, No. 512 (C–0898) 26 Dec. 1991 of JP–A–03 226 550 (Nippon Steel) 7 Oct. 1991.

Patent Abstracts of Japan, vol. 12, No. 338 (C–527) 12 Sep. 1988 of JP–A–63 096 294 (Nippon Steel Corp) 27 Apr. 1988.

Patent Abstracts of Japan, vol. 16, No. 148 (C–0928) 13 Apr. 1992 of JP–A–04 006 259 (Nippon Steel Corp) 10 Jan. 1992.

*Primary Examiner*—Sam Silverberg

*Attorney, Agent, or Firm*—Frishauf, Holtz, Goodman, Langer & Chick

[57] ABSTRACT

A method for producing zinc coated steel sheet comprises the steps of: forming a Ni—P alloy coating layer containing P of 8 to 15 wt. % on at least one surface of a steel sheet; heat-treating the steel sheet coated with the alloy layer in a non-oxidizing atmosphere to form an Fe—Ni—P diffused alloy layer at an interface of the steel sheet and the alloy coating layer; and zinc coating the steel sheet coated with the diffused alloy layer to form a zinc coating layer.

56 Claims, No Drawings

METHOD FOR PRODUCING ZINC COATED STEEL SHEET

BACKGROUND OF THE INVENTION

1. Field of the Invention

The present invention relates to a method for producing a zinc coated steel sheet having excellent corrosion resistance suitable for automobile sheets.

2. Description of the Related Arts

Steel sheets of an automobile body are mainly rust-resistant steel sheets from the viewpoint of reliability to sustaining rust preventive performance for a long period of service. Among various kinds of the rust-resistant steel sheets, a zinc coated steel sheet and an alloyed zinc coated steel sheet are most widely used. Apart from the zinc coated steel sheet and the alloyed zinc coated steel sheet, corrosion-resistant steel sheets which improve their own corrosion resistance by their composition are also used. Examples of that type of corrosion-resistant steel sheet are disclosed in JP-A-54-75421 and JP-A-56-9356 (the term "P-A-" referred to herein signifies "unexamined Japanese patent publication"). Responding to the ever-increasing demand for corrosion resistance, a method to further improve the corrosion resistance of the corrosion-resistant steel sheet by applying a zinc coating to the surface of the steel sheet has also been proposed. An example of that kind of method for improving corrosion resistance is disclosed in JP-A-59-170288.

In a corrosion-resistant steel sheet, the corrosion resistance is maintained with a stable rust layer which is formed on the surface of the steel sheet during the corrosion process. To form the stable rust layer, various kinds of additives are required, and a significant amount of those additives are needed to obtain a satisfactory corrosion resistance. The additives effectively used to form the stable rust layer are, however, limited to those applied during steelmaking process and existing in the surface layer among those uniformly distributed within the steel sheet. In other words, those additives which remain inside the steel sheet are useless in terms of corrosion resistance. On the other hand, the additives also play a role to control the mechanical characteristics of the steel sheet. Accordingly, a restriction of the mechanical characteristics sometimes limits the amount of the additives for improving the corrosion resistance, which suppresses the sufficient effect of corrosion resistance.

A method disclosed in JP-A-59-170288 improves the corrosion resistance by forming a zinc coating layer on a corrosion-resistant steel sheet. However, the presented zinc coating is an alloy applied by electroplating, and the method has a disadvantage of high production cost compared with hot dip galvanizing method. The hot dip galvanizing has an advantage of lower cost than the electroplating, but the former has a disadvantage of rather poor workability and poor adhesiveness of the coating layer under a certain combination of steel sheet composition and amount of additives. The reason of the disadvantage is that the workability and adhesiveness of the hot dip galvanizing largely depend on the alloy layer formed by the reaction between the hot dip galvanized layer and the steel sheet and that a part of the additives interfere with the reaction to induce irregular formation of the alloy layer.

JP-A-3-24255 and JP-A-62-139860 disclose a method for improving the adhesiveness of coating layer by applying a "precoating" on the steel sheet surface by electroplating followed by hot dip galvanizing. This method, however, aims mainly to improve the adhesiveness of the coating layer by "pre-coating", and a very little effect of corrosion resistance is expected. In other words, this method does not consider the composition, amount, and mode of the "pre-coating" necessary to improve the corrosion resistance. JP-A-57-171692 discloses a method for coating steel sheet, where a nickel layer is coated on a steel sheet, and a nickel diffusion layer is formed within the steel sheet by heating the steel sheet in a non-oxidizing atmosphere, and a Zn—Ni alloy coating is applied on the steel sheet. Although the coating layer during corrosion process or the Ni—Fe diffusion layer after disappearance of corrosion products contributes to the improvement of corrosion resistance, but the effect is not sufficient. The reason of insufficient effect is presumably that the presence of a Ni—Fe diffusion layer stabilizes the surface condition of the steel sheet to suppress the beginning of corrosion and that once the corrosion of the base iron plate starts, however, the insufficient density of the corrosion products allows an easy permeation of water or oxygen which enhances the corrosion through the corrosion products, which can not inhibit the progress of corrosion.

JP-B-61-60914 (the term "JP-B-" referred to herein signifies "examined Japanese patent publication") discloses a technology relating to a high corrosion-resistance surface treated steel sheet. In this technology, a coating of a metal selected from the group of Zn, Ni, Sn, Cr, or an alloy consisting mainly of these metals is applied to the steel sheet. The coated steel sheet is heated in a nonoxidizing atmosphere to form a metallic diffusion layer in the steel. Then, a Zn—Ni alloy coating is applied on the metal surface. The technology, however, also gives less effect for improving corrosion resistance once the corrosion of base iron plate occurs because the components such as Zn, Ni, Sn, Cr, etc. give less contribution to the densification of the corrosion products.

SUMMARY OF THE INVENTION

The object of the present invention is to provide a method for producing a zinc coated steel sheet having excellent corrosion resistance.

To achieve the object, the present invention provides a method for producing a zinc coated steel sheet, comprising the steps of:

forming a Ni—P alloy coating layer containing P of 8 to 15 wt. % on at least one surface of a steel sheet;

heat-treating the steel sheet coated with the alloy coating layer in a non-oxidizing atmosphere to form an Fe—Ni—P diffused alloy layer at an interface of the steel sheet and the alloy coating layer; and hot-dip galvanizing the steel sheet coated with the diffused alloy layer to form a hot-dip galvanizing coating layer.

The present invention also provides a method for producing a zinc coated steel sheet, comprising the steps of:

forming a Ni—P alloy coating layer containing P of 8 to 15 wt. % on at least one surface of a steel sheet;

heat-treating the steel sheet coated with the alloy coating layer in a non-oxidizing atmosphere to form an Fe—Ni—P diffused alloy layer at an interface of the steel sheet and the ahoy coating layer; and zinc-electroplating the steel sheet coated with the diffused alloy layer to form a zinc electroplated layer.

The present invention further provides a method for a producing zinc coated steel sheet, comprising the steps of:

forming a Ni—P alloy coating layer containing P of 8 to 15 wt. % on at least one surface of a steel sheet;

cold-rolling the steel sheet coated with the alloy coating layer;

heat-treating the cold-rolled steel sheet in a non-oxidizing atmosphere to form an Fe—Ni—P diffused alloy layer at an interface of the steel sheet and the alloy coating layer; and zinc-coating the steel sheet coated with the diffused alloy layer to form a zinc coating layer.

DESCRIPTION OF THE PREFERRED EMBODIMENT

Embodiment-1

Steel sheets applied in the present invention are hot-rolled steel sheets or the like, and their thickness is of 1.6 to 4.5 mm. The steel sheets of the present invention include steel strips. Before applying the treatment related to the present invention, the steel sheets undergo pickling and descaling. On one or both sides of the steel sheets are coated with a Ni—P alloy coating layer. The Ni—P coating layer has a Ni—P alloy composition containing P of 8 to 15 wt. %. The reason of limiting the P content is that a Ni—P alloy coating having the composition shows an amorphous-like structure. When a steel sheet having that type of coating layer is subjected to heat treatment, a uniform diffused alloy layer which is more uniform than general crystalline coating film is formed within a short period. Addition of less than 8 wt. % P gives a crystalline Ni—P alloy coating layer and results in a non-uniform distribution of P. As a result, a stable corrosion resistance can not be obtained because the composition of a diffused alloy layer formed during a heat treatment is not uniform and because the homogeneity and denseness of the rust formed during the initial stage of corrosion process are not sufficient. Addition of above 15 wt. % P induces a brittle Ni—P alloy coating and results in a poor adhesiveness of the coating layer. Consequently, an excessive addition of P tends to separate the coating layer before forming a hot dip galvanized layer. Therefore, the present invention specifies the content of P in the above described range. The preferable P content is in a range of from 10 to 13 wt. %.

A steel sheet may be coated with a Ni—P alloy system coating layer which is a composite of Ni—P combined with at least one element selected from the group of W, Mo, Cr, and Cu in an amount of up to 15 wt. %. The role of Ni and P is described above. As for the role of W, Mo, Cr, and Cu, they play a role of an inhibitor against the corrosion of steel and they also provide an effect to further improve the denseness and stability of the rust generated in the initial stage of corrosion process owing to the synergistic effect with Ni and P. Regarding the content of W, Mo, Cr, and Cu, the present invention specifies the sum of them as 15 wt. % or less. An increase of the content of W, Mo, Cr, and Cu improves the corrosion resistance. However, when the sum of the W, Mo, Cr, and Cu content exceeds 15 wt. %, the adhesiveness of formed coating layer degrades, and the separation of coating layer tends to occur before forming a hot dip galvanized coating layer. Therefore, the present invention specifies the content of the sum of W, Mo, Cr, and Cu to the range described above. A preferable lower limit of the content to perform the effect of W, Mo, Cr, and Cu is 0.5 wt. %.

A preferred range of coating weight of the Ni—P alloy coating layer is from 0.5 to 8 g/m$^2$. If the coating weight is less than 0.5 g/m$^2$, the effect for improving the corrosion resistance is not necessarily sufficient, and if the coating weight exceeds 8 g/m$^2$, the performance improvement can not correspond to the cost increase, which is not efficient for a practical point of view.

There are several proposed methods for forming a Ni—P alloy coating layer. However, electroplating or electroless coating (chemical coating) is preferable from the standpoint of simple operation and uniformity of obtained film quality. As for a wet coating method, the coating can be applied after the pickling treatment at the exit of the picking. This treatment allows to form effectively a pre-coating film having a good adhesiveness without giving a further cleaning stage to the hot rolled steel sheet which was pickled and activated.

In the steel sheet coated with the Ni—P ahoy coating layer (pre-coating layer), an Fe—Ni—P diffused alloy layer is formed by heating the steel sheet. The thermal diffusion can be performed by using a hot dip galvanizing equipment. For example, a continuous hot dip galvanizing facility of the Sendzimir type is provided with a heat treatment furnace operated in a non-oxidizing atmosphere aiming at the annealing and the surface activation of the steel sheets. The Ni—P alloy coating layer undergoes an adequate heat treatment in the heat treatment full, ace, where the coating layer reacts with the steel base plate to form an alloy layer by mutual diffusion of Fe, Ni, and P. A preferable maximum sheet temperature of the heat treatment is from 500° C. to 800° C. A temperature below 500° C. does not form a sufficient diffused alloy layer between the Ni—P alloy coating layer and the steel sheet surface, and gives less effect for improving the corrosion resistance because a stable initial stage rust can not be formed during the corrosion process. On the other hand, a temperature above 800° C. likely induces pickup of coating metal onto the rolls inside of the heat treatment furnace, and may cause surface flaws.

The holding time at the maximum sheet temperature is preferably from 1 to 30 sec., though it depends on the temperature level. A holding time of less than 1 sec. hardly forms the sufficient diffused ahoy layer, and results in an insufficient improvement of corrosion resistance. A holding time above 30 sec. tends to induce a brittle interface layer caused by an excessive diffusion alloying phenomenon, which may degrade the adhesiveness and workability of the coating layer.

The preferred depth of the diffused ahoy layer is from 0.1 to 20 μm to effectively function the adhesiveness and workability of the coating layer. When a Ni—P alloy coating layer undergoes heat treatment, two types of coating structure appear. The one is that a part of the Ni—P alloy coating layer forms a diffused alloy layer and forms the steel sheet/diffused alloy layer/Ni—P alloy coating layer structure. The other is that all the Ni—P alloy coating layer forms a diffused alloy layer to give the steel sheet/diffused alloy layer structure. The present invention includes both cases.

After forming the diffused alloy layer, the steel sheet is fed to the hot dip galvanizing bath. The coating weight of the hot dip galvanized coating is preferably of 20 to 120 g/m$^2$. Too small a coating weight can not give a good corrosion resistance, and excessive coating weight degrades the workability of coating layer. Hot dip galvanizing bath may be the one containing a slight amount of Al, which has widely been used. For an application needing a better paintability, a formed hot dip galvanized coating to a specified coating weight may successively be heated to alloy the coating layer. The alloying rate is calculated as follows; Fe and a part of the components in the Ni—P alloy layer are divided by the hot dip galvanized coating layer. The alloying rate is expressed by wt. %. The preferred alloying rate is in a range of from 7 to 15 wt. %. The alloying rate below 7 wt. % is difficult to obtain the effect for improving paintability, and the alloying rate above 15 wt. % tends to degrade the workability of coating layer.

The zinc coated steel sheet of the present invention obtained by the procedure described above gives better corrosion resistance than a zinc coated steel sheet prepared by a conventional method. The presumable reason is that, according to the present invention, a diffused alloy layer consisting mainly of Fe—Ni—P is formed at the interface between the base steel sheet and the coating layer and that the formed intermediate layer contributes to the improvement of corrosion resistance. Although the detail of the corrosion-resistance mechanism has not been clarified, the inventors assume that the intermediate diffused alloy layer forms a uniform and dense iron rust during the initial stage of corrosion process, which suppresses the cathode reaction.

EXAMPLE 1

Three types of steel sheets as the base plate for coating underwent Ni—P alloy coating to form a Ni—P alloy coating layer on the surface thereof. Hereinafter the Ni—P alloy coating is referred to as the "pre-coating". The pre-coated steel sheets were subjected to heat treatment to form the diffused alloy layer of Fe—Ni—P system on the surface thereof. After the heat treatment, hot dip galvanizing was applied to the steel sheets.

Table 1 shows the thickness and composition of the steel sheets employed. The steel sheet C is a corrosion resistant steel sheet containing Cr and Mo. Table 2 shows the pre-coating condition. The composition of the coating solution is represented by the unit of gram per liter. The pre-coating of No. 8, 9, 10, and 15 were prepared by electroless coating. The coating solution contained a pH buffer agent or stabilizer such as boric acid and sodium citrate. The coating weight was adjusted by changing the current density and the coating time. Table 3 shows the condition of pre-coating, heat treatment, and hot dip galvanizing, along with the evaluation on corrosion resistance for the obtained coated steel sheets. Example 1 was conducted using small test pieces in a laboratory coating simulator. The test pieces No. 1 through 12, 16 through 18, and 21 through 39 in Table 3 were the examples of the present invention. The test pieces No. 13 through 15, 19, 20, and 40 through 46 were the comparative examples differ from the scope of the present invention. Test pieces No. 13 and 45 were the case where no Ni—P alloy coating was applied. Test pieces No. 14, 15, 40, and 41 were the case where the pre-coating weight was outside of the range of the present invention. The test pieces No. 19, 20, 43, and 44 were the case where the P content was outside of the range of this invention. The test piece No. 46 was the case of Zn—Ni alloy coating.

The conditions of hot dip galvanizing were as follows:

(1) Atmosphere of heat treatment: 25% $H_2$ and 75% $N_2$ (2) Composition of coating bath: coating bath containing 0.13±0.01 wt. % Al (3) Temperature of coating bath: 460° C.±10° C.

(4) Condition of alloying the coating: sheet temperature of 500° to 550° C., holding time of 3 to 10 sec.

The evaluation method and its criteria for a coated steel sheet are given below.

(1) Corrosion resistance: The test piece without painting is allowed to stand for 60 days under the corrosive condition of repeated drying and humidifying combined with salt water spraying. The resulted corrosion depth was measured to evaluate in accordance with the criterion given below.

○: the maximum corrosion depth is 0.5 mm or less

Δ: the maximum corrosion depth is deeper than 0.5 mm and not deeper than 0.2 mm x: the maximum corrosion depth is deeper than 0.2 mm (2) Adhesiveness of coating layer: The test piece undergoes the 180 degree bending test to observe the damage of coating layer at the tip of bent. The evaluation was given in accordance with the following criterion.

○: no damage or only fine cracks are observed

Δ: large crack is observed or partial separation of coating layer is observed x: coating separation is observed in a wide range (3) Paintability: The test piece undergoes phosphate treatment, followed by cation electrodeposition. The treated test piece is scratched with a knife edge down to the base plate surface. The scratched test piece is exposed to the corrosion atmosphere similar with (1) for 100 days. The resulting blister of coating at the scratched area is observed to give the evaluation in accordance with the criterion given below.

◎: the maximum blister width on one side is 1 mm or less

○: the maximum blister width on one side is over 1 mm and not larger than 3 mm

Δ: the maximum blister width on one side is over 3 mm

Table 3 shows that the present invention effectively produces a zinc coated steel sheet having a good corrosion resistance. According to the present invention, the addition of a small amount of corrosion-resistance-improving component to the interface of coating layer and steel sheet surface significantly improves the corrosion resistance without excessively adding that kind of additive to the whole body of the steel sheet. The present invention offers a considerable advantage to the steel sheet production cost, and the present invention also provides a better corrosion-resistant steel sheet than conventional corrosion-resistant steel sheets (high Cr, and Mo addition) coated with Zn layer, which is proved by the test pieces No. 45 and 46. The presumed cause of the latter advantage is that the interface diffusion layer formed by the "pre-coating" is superior to the coating of conventional methods in terms of forming a stable and dense rust during the initial stage of corrosion process. In addition, the present invention provided better workability of a coating layer than conventional methods. The reason of the good workability of coating layer is presumably due to the effect of Ni by the method of the present invention to enhance the uniform reaction between the steel and zinc to form an alloy layer having a good adhesiveness.

Furthermore, according to the present invention, it is possible to reduce the coating weight of the zinc coating or the alloyed zinc coating while maintaining the corrosion resistance. The present invention further improves the workability of the coating layer and the weldability (for example, anti-blow hole characteristic in arc welding). From a long term point of view, the reduction of the amount of zinc in scrap offers an effective recycling of resources.

As described above, the present invention provides a method for effectively producing a zinc coated steel sheet having a good corrosion resistance without applying large amount of corrosion-resistance-improving component to the steel sheet and offers a considerable merit to the production cost of steel sheets. In addition, the present invention reduces the coating weight of a zinc coating layer or an alloyed the coating layer, and the reduction of zinc amount of zinc in scrap is effective also in the recycling of resources. Furthermore, the present invention improves the workability and weldability (for example, anti-blow hole characteristic in arc welding) of a coating layer.

TABLE 1

| | Plate thickness | C | Si | Mn | P | S | Al | Cu | Cr | Mo |
|---|---|---|---|---|---|---|---|---|---|---|
| A | 2.8 mm | 0.06 | 0.02 | 0.5 | 0.03 | 0.002 | 0.03 | — | — | — |
| B | 2.8 mm | 0.05 | 0.04 | 1.2 | 0.05 | 0.002 | 0.05 | — | — | — |
| C | 2.8 mm | 0.03 | 0.01 | 0.03 | 0.02 | 0.012 | 0.04 | 0.01 | 1.0 | 0.3 |

TABLE 2

| | Coating layer composition (wt. %) | Coating solution composition (g/l) | | | | | |
|---|---|---|---|---|---|---|---|
| | | Nickel sulfate | Phosphorous acid | Chromium sulfate | Copper sulfate | Sodium molybdate | Sodium tungstate |
| 1 | Ni-11% P | 250 | 30 | — | — | — | — |
| 2 | Ni-14% P | 250 | 50 | — | — | — | — |
| 3 | Ni-11% P-3% Cr | 250 | 35 | 50 | — | — | — |
| 4 | Ni-11% P-12% Cr | 250 | 35 | 150 | — | — | — |
| 5 | Ni-15% P-1% Mo | 250 | 50 | — | — | 40 | — |
| 6 | Ni-15% P-8% Mo | 250 | 50 | — | — | 100 | — |
| 7 | Ni-11% P-5% Cr-1% Mo | 250 | 35 | 70 | — | 30 | — |
| 8 | Ni-12% P | 30 | 30 (hypophosphorous acid) | | — | — | |
| 9 | Ni-11% P-12% W | 30 | 30 (hypophosphorous acid) | | | — | 60 |
| 10 | Ni-10% P-15% Cu | 30 | 30 (hypophosphorous acid) | | 3 | — | — |
| 11 | Ni-7% P | 250 | 20 | — | — | — | — |
| 12 | Ni-16% P | 250 | 60 | — | — | — | — |
| 13 | Ni-5% P-10% Cr | 250 | 15 | — | — | — | — |
| 14 | Ni-10% P-16% Mo | 250 | 35 | — | — | 150 | — |
| 15 | Ni-11% P-16% W | 30 | 30 (hypophosphorous acid) | | — | — | 100 |

TABLE 3

| | Base plate | Precoating Type | Precoating Coating weight | Maximum plate temperature | Hot dip galvanizing Holding time | Hot dip galvanizing Coating weight | Hot dip galvanizing Alloying rate | Corrosion resistance | Adhesiveness | Paintability | |
|---|---|---|---|---|---|---|---|---|---|---|---|
| 1 | A | 1 | 0.5 g/m$^2$ | 600° C. | 10 sec. | 45 g/m$^2$ | — | ○ | ○ | ○ | Example |
| 2 | A | 1 | 3 | 600 | 10 | 45 | — | ○ | ○ | ○ | Example |
| 3 | A | 1 | 3 | 520 | 30 | 45 | — | ○ | ○ | ○ | Example |
| 4 | A | 1 | 5 | 780 | 5 | 45 | — | ○ | ○ | ○ | Example |
| 5 | A | 1 | 3 | 780 | 1 | 45 | — | ○ | ○ | ○ | Example |
| 6 | A | 1 | 3 | 520 | 30 | 45 | — | ○ | ○ | ○ | Example |
| 7 | A | 1 | 3 | 600 | 10 | 20 | — | ○ | ○ | ○ | Example |
| 8 | A | 1 | 3 | 600 | 10 | 120 | — | ○ | ○ | ○ | Example |
| 9 | A | 1 | 8 | 600 | 10 | 45 | — | ○ | ○ | ○ | Example |
| 10 | A | 1 | 3 | 550 | 15 | 45 | 7 wt. % | ○ | ○ | ⊙ | Example |
| 11 | A | 1 | 3 | 550 | 15 | 45 | 11 wt. % | ○ | ○ | ⊙ | Example |
| 12 | A | 1 | 3 | 550 | 15 | 45 | 15 wt.% | ○ | ○ | ⊙ | Example |
| 13 | A | — | — | 600 | 10 | 45 | — | X | ○ | ○ | Comparative Example |
| 14 | A | 1 | 0.4 | 600 | 10 | 45 | — | Δ | ○ | ○ | Comparative Example |
| 15 | A | 1 | 9 | 600 | 10 | 45 | — | ○ | X | ○ | Comparative Example |
| 16 | A | 1 | 5 | 550 | 10 | 60 | — | ○ | ○ | ○ | Example |
| 17 | A | 2 | 5 | 550 | 10 | 60 | — | ○ | ○ | ○ | Example |
| 18 | A | 8 | 5 | 550 | 10 | 60 | — | ○ | ○ | ○ | Example |
| 19 | A | 11 | 5 | 550 | 10 | 60 | — | Δ | ○ | ○ | Comparative Example |
| 20 | A | 12 | 5 | 550 | 10 | 60 | — | Δ | Δ | ○ | Comparative Example |
| 21 | A | 3 | 2 | 520 | 20 | 30 | — | ○ | ○ | ○ | Example |
| 22 | A | 4 | 2 | 520 | 20 | 30 | — | ○ | ○ | ○ | Example |
| 23 | A | 5 | 2 | 520 | 20 | 30 | — | ○ | ○ | ○ | Example |
| 24 | A | 6 | 2 g/m$^2$ | 520° C. | 20 sec. | 25 g/m$^2$ | — | ○ | ○ | ○ | Example |
| 25 | A | 7 | 2 | 520 | 20 | 25 | — | ○ | ○ | ○ | Example |
| 26 | A | 9 | 2 | 520 | 20 | 30 | — | ○ | ○ | ○ | Example |

TABLE 3-continued

| | Base plate | Precoating Type | Precoating Coating weight | Maximum plate temperature | Holding time | Hot dip galvanizing Coating weight | Hot dip galvanizing Alloying rate | Corrosion resistance | Adhesiveness | Paintability | |
|---|---|---|---|---|---|---|---|---|---|---|---|
| 27 | A | 10 | 2 | 520 | 20 | 30 | — | ○ | ○ | ○ | Example |
| 28 | B | 6 | 0.5 | 550 | 10 | 45 | — | ○ | ○ | ○ | Example |
| 29 | B | 6 | 8 | 780 | 5 | 45 | — | ○ | ○ | ○ | Example |
| 30 | B | 6 | 3 | 780 | 1 | 45 | — | ○ | ○ | ○ | Example |
| 31 | B | 6 | 3 | 550 | 10 | 25 | 7 wt. % | ○ | ○ | ○ | Example |
| 32 | B | 6 | 3 | 550 | 10 | 25 | 15 wt. % | ○ | ○ | ◎ | Example |
| 33 | B | 6 | 3 | 520 | 30 | 60 | — | ○ | ○ | ◎ | Example |
| 34 | B | 9 | 2 | 650 | 5 | 30 | — | ○ | ○ | ○ | Example |
| 35 | B | 9 | 3 | 600 | 5 | 30 | — | ○ | ○ | ○ | Example |
| 36 | B | 9 | 3 | 600 | 5 | 20 | — | ○ | ○ | ○ | Example |
| 37 | B | 9 | 3 | 600 | 5 | 120 | — | ○ | ○ | ○ | Example |
| 38 | B | 9 | 2 | 550 | 10 | 45 | 7 wt. % | ○ | ○ | ◎ | Example |
| 39 | B | 9 | 2 | 550 | 10 | 45 | 15 wt. % | ○ | ○ | ◎ | Example |
| 40 | B | 6 | 0.4 | 550 | 10 | 45 | — | Δ | ○ | ○ | Comparative Example |
| 41 | B | 6 | 9 | 780 | 5 | 45 | — | ○ | ○ | X | Comparative Example |
| 42 | B | 13 | 3 | 550 | 10 | 45 | — | Δ | ○ | ○ | Comparative Example |
| 43 | B | 14 | 3 | 550 | 10 | 45 | — | ○ | Δ | ○ | Comparative Example |
| 44 | B | 15 | 3 | 550 | 10 | 45 | — | ○ | Δ | ○ | Comparative Example |
| 45 | C | — | — | 550 | 10 | 45 | — | Δ | X | Δ | Comparative Example |
| 46 | C | — | — | Zn-Ni alloy electroplating | | 30 | 13 wt. % Ni | Δ | ○ | X | Comparative Example |

Embodiment-2

According to the present invention, a Ni—P alloy coating layer containing P of 8 to 15 wt. % is formed on a cold-rolled steel sheet. The Ni—P alloy coating containing P of 8 to 15 wt. % shows an amorphous-like structure. When a steel sheet having that type of coating layer is subjected to heat treatment, a uniformly diffused alloy layer which is more uniform than a general crystalline coating film is formed within a short period. Since the diffusion layer contains P, the iron corrosion products formed after the initiation of corrosion at the base plate iron gives an extremely dense structure. As a result, a corrosion resistance which could not be obtained by conventional technology is attained.

The P content of less than 8 wt. % gives a crystalline Ni—P alloy coating layer and results in a non-uniform distribution of P. As a result, an excellent corrosion resistance can not be obtained because the composition of diffused alloy layer formed in a heat treatment is not uniform and because the contribution to the densification of the rust generated in the base steel plate is not sufficient. Addition of above 15 wt. % P induces a brittle Ni—P alloy coating and results in a poor adhesiveness of the coating layer. Consequently, an excessive addition of P tends to separate the coating layer during heat treatment and other processing. Therefore, the present invention specifies the content of P in the coating layer of the steel sheet in a range of 8 to 15 wt. %. More preferably the P content is in a range of 10 to 13 wt. %.

A steel sheet may be coated with a Ni—P alloy coating layer which is a composite of Ni—P combined with at least one element selected from the group of W, Mo, and Cu in an amount of 15 wt. % or less after the cold-rolling stage. As for the role of W, Mo, and Cu, they play a role of inhibitor against the corrosion of steel and they also provide an effect to further improve the denseness and stability of the rust generated in the initial stage of corrosion process owing to the synergistic effect with Ni and P. The preferable content of W, Mo, and Cu is the sum of them at 15 wt. % or less. An increase of the content of W, Mo, and Cu improves the corrosion resistance. However, when the sum of the W, Mo, and Cu content exceeds 15 wt. %, the adhesiveness of the formed coating layer degrades, and the separation of coating layer tends to occur in the succeeding treatments. Therefore, the present invention specifies the content of the sum of W, Mo, and Cu as 15 wt. % as the total amount of these elements. A preferable lower limit of the content to perform the effect of W, Mo, and Cu is 0.5 wt. %.

The range of coating weight of the Ni—P ahoy coating layer is not limitive, but a preferred range is from 0.1 to 8 $g/m^2$. If the coating weight is too small, the effect for improving the corrosion resistance is not sufficient. If the coating weight is excessive, the performance improvement can not correspond to the cost increase, which is not efficient for practical point of view. Furthermore, the latter case needs to slow the line speed to increase the coating weight, which degrades the production efficiency.

There are several proposed methods for forming a Ni—P alloy coating layer. However, electroplating or electroless coating (chemical coating) is preferable from the stand point of simple operation and uniformity of obtained film quality.

A steel sheet coated with Ni—P coating layer is a cold-rolled material, and the usefulness of the present invention is effectively achieved when a very low carbon steel having especially good mechanical characteristics is employed. The very low carbon steel has the C content of solid a solution as low as several tens of ppm (normally in a range of from 30 to 50 ppm) and has very high purity of the steel sheet, so the corrosion resistance of that type of steel tends to be inferior to ordinary low carbon steels. Nevertheless, the method of the present invention compensates for the disadvantage of base steel and provides a steel sheet having both the good mechanical characteristics and the high corrosion resistance.

The steel sheet coated with a Ni—P ahoy coating layer undergoes a heat treatment in a non-oxidizing atmosphere to form a diffused alloy layer consisting mainly of Fe—Ni—P at the interface between the base steel plate and the coating layer. Preferable non-oxidizing atmosphere is an argon atmosphere, a nitrogen atmosphere, or a reducing atmosphere containing a specified amount of hydrogen gas and balance of inert gas. The heat treatment for diffusion may be carried out in an ordinary annealing facility after cold rolling. At that heat treatment, a normal annealing may be conducted to perform the heat treatment at a time. A preferred maximum temperature of the heat treatment is of 500° to 850° C. The heat treatment at below 500° C. can not form a sufficient diffusion layer between the Ni—P alloy coating layer and the steel sheet surface, and the insufficient dense rust formation during the corrosion process results in a small effect for improving corrosion resistance. On the other hand, the heat treatment at above 850° C. tends to induce a pickup of coating metal to the surface of rolls in the heat treatment furnace, which may cause the surface flaw on the steel sheets. A preferred range of holding time at the maximum temperature of the steel sheet is 1 to 120 sec., though the holding time depends on the temperature. Too short a holding time does not give the improving effect of corrosion resistance because sufficient diffusion layer can not be formed. An excessive holding time induces an excessive diffusion alloying, which results in a brittle interface layer to degrade the adhesiveness and workability of the coating layer. During the heat treatment, an overaging may be applied for several minutes at an approximate temperature range of from 300° to 400° C. A preferable depth of appropriate diffusion layer formed by the heat treatment is in a range of from 0.1 to 20 μm. When a Ni—P alloy coating layer undergoes heat treatment, two types of coating structure appear. One is that a part of the Ni—P alloy coating layer forms a diffused alloy layer and forms the steel sheet/diffused alloy layer/Ni—P alloy coating layer structure. The other is that all the Ni—P alloy coating layer forms a diffused alloy layer to give the steel sheet/diffused alloy layer structure. The present invention includes both cases.

After the heat treatment for diffusion, a temper rolling is conducted under an adequate condition, at need. The steel sheet that has undergone such a treatment is subjected to an electroplating in the electroplating line. Regarding the electroplating, an effective mode is the Zn electroplating having Zn as the matrix and containing at least one metal or oxide selected from the group of Ni, Fe, Co, Cr, Mn, Ti, Mo, Si, and Al in a form of alloy or of dispersed particles. That type of coating is inert for coating corrosion so that it contributes to the corrosion resistance during the coating corrosion process. At the same time, the synergistic effect of the components in the Zn matrix and the components existing in the diffusion layer, such as Ni, P, etc., gives an effect on the rust stabilization and densification in the base iron plate. Particularly, as for the Zn—Cr coating, Cr in the coating film performs a synergistic effect with the components such as P in the diffusion treatment layer even after the disappearance of the coating, and the Zn—Cr coating is effective for stabilizing and densifying the rust in the base iron plate. Accordingly, the Zn—Cr coating gives particularly high corrosion resistance among the above discussed coatings.

A preferable zinc coating weight of zing electroplating is in a range of from 1 to 30 g/m$^2$. Too small coating a weight can not give a sufficient corrosion resistance, and excessive coating weight degrades the workability of coating layer and increases the production cost. For a zinc electroplating bath, a widely used sulfuric acid bath and chloride bath may be employed. The coating films produced by these electroplating baths are Zn film, Zn—Ni film, Zn—Cr film, Zn—Fe film, Zn—Cr—Ni film, Zn—Cr—Mo film, etc. A preferable content of alloy or dispersed particles existing in the zinc electroplating layer is 1 wt. % or more as the total amount for the effective functioning of the effect, and 70 wt. % or less because an excessive components other than Zn degrades the adhesiveness of the film.

For further improvement of corrosion resistance, a chromate treatment may be applied on the zinc electroplating layer, and further an organic composite resin coating may be applied. As for the chromate treatment, either one of the reaction type, the electrolysis type, and the application type is applicable. The chromate film may contain organic compounds such as acrylic resin, oxide colloid such as silica colloid and alumina colloid, acid such as molybdenum oxide, salt, or other corrosion-resistance-improving components. The organic resin film which coats the chromate film may an use epoxy resin as the base resin. The organic resin film preferably further contains a rust preventive additive such as silica and chromate at an approximate range of from 10 to 60 wt. %.

EXAMPLE 2

After being coated with a Ni—P layer, the cold-rolled steel sheets underwent heat treatment in a non-oxidizing atmosphere. The Ni—P coating or the like is hereinafter referred to as "pre-coating". The heat-treated steel sheets were subjected to preliminary treatment and coating to prepare test pieces. For comparison, test pieces which were treated by annealing and coating without applying Ni—P coating were also prepared.

Table 4 shows the thickness and composition of the cold-rolled steel sheets tested. The steel sheets No. A and B in Table 1 are the low carbon steel of the Example of the present invention, and No. C is the very low carbon steel of the Example of the present invention. The steel sheets No. D, E, and F are the high Cr steel, the high P steel, and the high Mo steel used in the Comparative Examples, respectively.

Table 5 shows the condition of pre-coating. The composition of coating solution is expressed by the unit of gram per liter. The conditions No. 1 through No. 10 are the pre-coating condition used in the Examples, and No. 11 through No. 20 are the precoating condition used in Comparative Examples. No. 8, 9, 10, and 15 are the condition of electroless coating. The coating solution contained a pH buffer agent such as boric acid and sodium citrate or stabilizer. The coating weight was adjusted by changing the current density and the coating time.

Table 6 shows the condition of zinc electroplating. The coating solution contained a conductive assistant such as sodium sulfate, a pH buffer agent such as sodium citrate, a brightening agent, and a deposition assistant, at need. The coating weight was adjusted by changing the current density and the coating time.

Tables 7(A) through (C) show the evaluation of various types of performance. The method and the criterion of evaluation were the same as in Example 1.

Tables 8(A) and (B) show the evaluation of various types of performance in Comparative Examples.

As clearly shown in Examples, the corrosion resistance of the products of the present invention is superior to the conventional corrosion-resistant steel sheets (high P, with addition of Cr and Mo) coated with Zn layer (Comparative Examples 22, 23, 24, and 25). Also for the kinds and compositions of pre-coating, the product of the present invention is better than those of Comparative Examples 6 through 18. The reason of the superiority is presumably the excellent performance of the interface diffusion layer formed by the "pre-coating" in terms of formation of a stable and dense rest during initial stage of corrosion process compared with the conventional processes.

Accordingly, the present invention effectively produces a zinc coated steel sheet having a good corrosion resistance with less coating weight. In addition, the present invention significantly improves the corrosion resistance by adding a small amount of corrosion-resistance-improving component to the interface between the coating layer and the steel sheet surface without adding a large amount of that type of component to the whole body of the steel sheet. The method offers a considerable merit to the production cost of the steel sheet, and the resulted corrosion resistance is better than that of conventional corrosion-resistant steel sheets (high P, with addition of Cr and Mo) coated with a Zn layer. Furthermore, regarding the kinds and composition of pre-coating, the corrosion resistance of the obtained steel sheets by the method of the present invention is better than the conventional steels.

TABLE 4

(wt. %)

| | Plate thickness | C | Si | Mn | P | S | Al | Cu | Cr | Mo | Ti |
|---|---|---|---|---|---|---|---|---|---|---|---|
| A | 0.8 mm | 0.06 | 0.02 | 0.5 | 0.03 | 0.002 | 0.03 | — | — | — | — |
| B | 0.8 mm | 0.05 | 0.04 | 1.2 | 0.05 | 0.002 | 0.05 | — | — | — | — |
| C | 0.8 mm | 0.002 | 0.01 | 0.2 | 0.08 | 0.003 | 0.06 | — | — | — | 0.11 |
| D | 0.8 mm | 0.02 | 0.01 | 0.2 | 0.03 | 0.012 | 0.04 | 0.03 | 0.8 | — | — |
| E | 0.8 mm | 0.01 | 0.01 | 0.2 | 0.1 | 0.012 | 0.04 | 0.1 | — | — | — |
| F | 0.8 mm | 0.05 | 0.01 | 0.3 | 0.02 | 0.012 | 0.04 | 0.01 | 1.0 | 0.3 | — |

TABLE 5

| Coating layer composition (wt. %) | Nickel sulfate | Phosphorous acid | Copper sulfate | Sodium molybdate | Sodium tungstate | Zinc sulfate | Chromium sulfate | Cobalt sulfate |
|---|---|---|---|---|---|---|---|---|
| 1 Ni-11% P | 250 | 30 | — | — | — | — | — | — |
| 2 Ni-14% P | 250 | 50 | — | — | — | — | — | — |
| 3 Ni-11% P-3% Cu | 250 | 35 | 1 | — | — | — | — | — |
| 4 Ni-11% P-12% Cu | 250 | 35 | 2 | — | — | — | — | — |
| 5 Ni-15% P-1% Mo | 250 | 50 | — | 40 | — | — | — | — |
| 6 Ni-15% P-8% Mo | 250 | 50 | — | 100 | — | — | — | — |
| 7 Ni-11% P-1% Mo | 250 | 35 | — | 30 | — | — | — | — |
| 8 Ni-12% P | 30 | 30 (hypophosphorous acid) | — | — | — | — | — | — |
| 9 Ni-11% P-12% W | 30 | 30 (hypophosphorous acid) | — | — | 60 | — | — | — |
| 10 Ni-10% P-15% Cu | 250 | 30 (hypophosphorous acid) | 2 | — | — | — | — | — |
| 11 Ni-7% P | 250 | 20 | — | — | — | — | — | — |
| 12 Ni-16% P | 250 | 20 | — | — | — | — | — | — |
| 13 Ni-5% P | 250 | 15 | — | — | — | — | — | — |
| 14 Ni-11% P-16% Mo | 250 | 35 | — | 150 | — | — | — | — |
| 15 Ni-11% P-16% W | 30 | 30 (hypophosphorous acid) | — | — | 100 | — | — | — |
| 16 Ni | 250 | — | — | — | — | — | — | — |
| 17 Zn | — | — | — | — | — | 300 | — | — |
| 18 Cr | — | — | — | — | — | — | 150 | — |
| 19 Ni-15% Co | 250 | — | — | — | — | — | — | 100 |
| 20 Cr-40% Ni | 250 | — | — | — | — | — | 200 | — |

TABLE 6

| Coating layer composition (wt. %) | Coating solution composition (g/l) | | | | | | | | | |
|---|---|---|---|---|---|---|---|---|---|---|
| | Zinc sulfate | Nickel sulfate | Ferrous sulfate | Chromium sulfate | Cobalt sulfate | Titanium sulfate | Sodium molybdate | Manganese sulfate | Alumina sol | Colloidal silica |
| 1 Zn-12% Ni | 150 | 350 | | | | | | | | |
| 2 Zn-11% Ni-2% Cr | 150 | 350 | | 50 | | | | | | |

TABLE 6-continued

| Coating layer composition (wt. %) | Coating solution composition (g/l) | | | | | | | | | |
|---|---|---|---|---|---|---|---|---|---|---|
| | Zinc sulfate | Nickel sulfate | Ferrous sulfate | Chromium sulfate | Cobalt sulfate | Titanium sulfate | Sodium molybdate | Manganese sulfate | Alumina sol | Colloidal silica |
| 3 Zn-13% Fe | 200 | | 300 | | | | | | | |
| 4 Zn-2% Cr | 250 | | | 400 | | | | | | |
| 5 Zn-4% Cr | 250 | | | 400 | | | | | | |
| 6 Zn-1% Cr oxide | 300 | | | 50 | | | | | | |
| 7 Zn-12% Cr | 250 | | | 400 | | | | | | |
| 8 Zn-32% Cr | 150 | | | 500 | | | | | | |
| 9 Zn-2% Cr-1% Co | 250 | | | 400 | | | | | | |
| 10 Zn-2% Cr-1% Ni | 240 | 180 | | 70 | | | | | | |
| 11 Zn-12% Cr-1% Co | 240 | | | 200 | 50 | | | | | |
| 12 Zn-12% Cr-1% Ni | 240 | 180 | | 200 | | | | | | |
| 13 Zn-2% Si oxide | 300 | | | | | | | | | 70 |
| 14 Zn-5% Si oxide | 300 | | | | | | | | | 70 |
| 15 Zn-60% Mn | 50 | | | | | | | 450 | | |
| 16 Zn-55% Mn-4% Cr | 50 | | | 100 | | | | 450 | | |
| 17 Zn-12% Cr-1% Mo | 250 | | | 400 | | | 50 | | | |
| 18 Zn-12% Cr-1% Ti | 250 | | | 400 | | 100 | | | | |
| 19 Zn-2% Ti oxide | 300 | | | | | 150 | | | | |
| 20 Zn-1% Si oxide-1% Cr oxide | 350 | | | | | 150 | 100 | | | |
| 21 Zn-14% Ni | 150 | 350 | | | | | | | | |
| 22 Zn-16% Ni | 100 | 400 | | | | | | | | |
| 23 Zn-15% Fe-1% Cr | 200 | | 300 | 150 | | | | | | |
| 24 Zn-2% Co-1% Cr-2% Al oxide | 350 | | | 100 | 100 | | | | 10 | |
| 25 Zn | 400 | | | | | | | | | |

TABLE 7

| No. | Base plate | Pre-coating condition: Type | Pre-coating condition: Coating weight ($g/m^2$) | Diffusion condition: Maximum plate temperature (°C.) | Diffusion condition: Holding time (sec.) | Zinc electroplating condition: Type | Zinc electroplating condition: Coating weight ($g/m^2$) | Corrosion resistance | Coating adhesiveness: Pre-coating | Coating adhesiveness: Zinc coating | Paintability |
|---|---|---|---|---|---|---|---|---|---|---|---|
| 1 | A | 1 | 0.1 | 600 | 20 | 7 | 20 | ◎ | ○ | ○ | ◎ |
| 2 | A | 1 | 0.3 | 500 | 10 | 7 | 20 | ◎ | ○ | ○ | ◎ |
| 3 | A | 1 | 0.3 | 700 | 25 | 7 | 20 | ◎ | ○ | ○ | ◎ |
| 4 | A | 1 | 3 | 820 | 10 | 7 | 20 | ◎ | ○ | ○ | ◎ |
| 5 | A | 1 | 5 | 600 | 20 | 7 | 20 | ◎ | ○ | ○ | ◎ |
| 6 | A | 1 | 7 | 650 | 10 | 7 | 20 | ◎ | ○ | ○ | ◎ |
| 7 | A | 1 | 8 | 750 | 5 | 7 | 20 | ◎ | ○ | ○ | ◎ |
| 8 | A | 1 | 6 | 850 | 1 | 7 | 20 | ◎ | ○ | ○ | ◎ |
| 9 | A | 1 | 5 | 770 | 20 | 7 | 1 | ◎ | ○ | ○ | ◎ |
| 10 | A | 1 | 5 | 770 | 20 | 7 | 15 | ◎ | ○ | ○ | ◎ |
| 11 | A | 1 | 5 | 770 | 20 | 7 | 25 | ◎ | ○ | ○ | ◎ |
| 12 | A | 1 | 5 | 770 | 20 | 7 | 30 | ◎ | ○ | ○ | ◎ |
| 13 | A | 1 | 5 | 770 | 60 | 1 | 20 | ○ | ○ | ○ | ○ |
| 14 | A | 1 | 5 | 770 | 60 | 2 | 20 | ○ | ○ | ○ | ◎ |
| 15 | A | 1 | 5 | 770 | 60 | 3 | 20 | ○ | ○ | ○ | ○ |
| 16 | A | 1 | 5 | 770 | 60 | 4 | 20 | ◎ | ○ | ○ | ◎ |
| 17 | A | 1 | 5 | 770 | 60 | 5 | 20 | ◎ | ○ | ○ | ◎ |
| 18 | A | 1 | 5 | 770 | 60 | 6 | 20 | ◎ | ○ | ○ | ◎ |
| 19 | A | 1 | 5 | 770 | 60 | 8 | 20 | ◎ | ○ | ○ | ◎ |
| 20 | A | 1 | 3 | 770 | 60 | 9 | 20 | ◎ | ○ | ○ | ◎ |
| 21 | A | 1 | 3 | 770 | 60 | 10 | 20 | ◎ | ○ | ○ | ◎ |
| 22 | A | 1 | 3 | 770 | 60 | 11 | 20 | ◎ | ○ | ○ | ◎ |
| 23 | A | 1 | 3 | 770 | 60 | 12 | 20 | ◎ | ○ | ○ | ◎ |
| 24 | A | 1 | 3 | 770 | 60 | 13 | 20 | ◎ | ○ | ○ | ◎ |
| 25 | A | 1 | 3 | 770 | 60 | 14 | 20 | ◎ | ○ | ○ | ◎ |
| 26 | A | 1 | 3 | 770 | 60 | 15 | 20 | ◎ | ○ | ○ | ◎ |
| 27 | A | 1 | 3 | 770 | 60 | 16 | 20 | ◎ | ○ | ○ | ◎ |
| 28 | A | 1 | 3 | 770 | 60 | 17 | 20 | ◎ | ○ | ○ | ◎ |
| 29 | A | 1 | 3 | 770 | 60 | 18 | 20 | ◎ | ○ | ○ | ◎ |
| 30 | A | 1 | 3 | 770 | 60 | 19 | 20 | ◎ | ○ | ○ | ◎ |
| 31 | A | 1 | 3 | 770 | 60 | 20 | 20 | ◎ | ○ | ○ | ◎ |
| 32 | A | 1 | 3 | 770 | 60 | 21 | 20 | ◎ | ○ | ○ | ◎ |
| 33 | A | 1 | 3 | 770 | 60 | 22 | 20 | ◎ | ○ | ○ | ◎ |
| 34 | A | 1 | 3 | 770 | 60 | 23 | 20 | ◎ | ○ | ○ | ◎ |
| 35 | A | 1 | 3 | 770 | 60 | 24 | 20 | ◎ | ○ | ○ | ◎ |
| 36 | A | 1 | 3 | 770 | 60 | 25 | 20 | ◎ | ○ | ○ | ◎ |
| 37 | A | 2 | 3 | 770 | 60 | 7 | 20 | ◎ | ○ | ○ | ◎ |

TABLE 7-continued

| No. | Base plate | Pre-coating condition: Type | Pre-coating condition: Coating weight (g/m²) | Diffusion condition: Maximum plate temperature (°C.) | Diffusion condition: Holding time (sec.) | Zinc electroplating condition: Type | Zinc electroplating condition: Coating weight (g/m²) | Corrosion resistance | Coating adhesiveness: Pre-coating | Coating adhesiveness: Zinc coating | Paintability |
|---|---|---|---|---|---|---|---|---|---|---|---|
| 38 | A | 2 | 3 | 770 | 60 | 9 | 20 | ◎ | ○ | ○ | ◎ |
| 39 | A | 2 | 3 | 770 | 60 | 14 | 20 | ◎ | ○ | ○ | ◎ |
| 40 | A | 3 | 3 | 770 | 60 | 7 | 20 | ◎ | ○ | ○ | ◎ |
| 41 | A | 3 | 3 | 770 | 60 | 9 | 20 | ◎ | ○ | ○ | ◎ |
| 42 | A | 3 | 3 | 770 | 60 | 14 | 20 | ◎ | ○ | ○ | ◎ |
| 43 | A | 4 | 3 | 770 | 60 | 7 | 20 | ◎ | ○ | ○ | ◎ |
| 44 | A | 4 | 3 | 770 | 60 | 9 | 20 | ◎ | ○ | ○ | ◎ |
| 45 | A | 4 | 3 | 770 | 60 | 14 | 20 | ◎ | ○ | ○ | ◎ |
| 46 | A | 5 | 3 | 770 | 60 | 7 | 20 | ◎ | ○ | ○ | ◎ |
| 47 | A | 5 | 3 | 770 | 60 | 9 | 20 | ◎ | ○ | ○ | ◎ |
| 48 | A | 5 | 3 | 770 | 60 | 14 | 20 | ◎ | ○ | ○ | ◎ |
| 49 | A | 6 | 3 | 770 | 60 | 7 | 20 | ◎ | ○ | ○ | ◎ |
| 50 | A | 6 | 3 | 770 | 60 | 9 | 20 | ◎ | ○ | ○ | ◎ |
| 51 | A | 6 | 3 | 770 | 60 | 14 | 20 | ◎ | ○ | ○ | ◎ |
| 52 | A | 7 | 3 | 770 | 60 | 7 | 20 | ◎ | ○ | ○ | ◎ |
| 53 | A | 7 | 3 | 770 | 60 | 9 | 20 | ◎ | ○ | ○ | ◎ |
| 54 | A | 7 | 3 | 770 | 60 | 17 | 20 | ◎ | ○ | ○ | ◎ |
| 55 | A | 8 | 3 | 770 | 60 | 7 | 20 | ◎ | ○ | ○ | ◎ |
| 56 | A | 8 | 3 | 770 | 60 | 9 | 20 | ◎ | ○ | ○ | ◎ |
| 57 | A | 8 | 3 | 770 | 60 | 14 | 20 | ◎ | ○ | ○ | ◎ |
| 58 | A | 9 | 3 | 770 | 60 | 7 | 20 | ◎ | ○ | ○ | ◎ |
| 59 | A | 9 | 3 | 770 | 60 | 9 | 20 | ◎ | ○ | ○ | ◎ |
| 60 | A | 9 | 3 | 770 | 60 | 14 | 20 | ◎ | ○ | ○ | ◎ |
| 61 | A | 10 | 3 | 770 | 60 | 7 | 20 | ◎ | ○ | ○ | ◎ |
| 62 | A | 10 | 3 | 770 | 60 | 9 | 20 | ◎ | ○ | ○ | ◎ |
| 63 | A | 10 | 3 | 550 | 10 | 14 | 20 | ◎ | ○ | ○ | ◎ |
| 64 | A | 1 | 3 | 750 | 1 | 7 | 20 | ◎ | ○ | ○ | ◎ |
| 65 | A | 1 | 3 | 750 | 5 | 7 | 20 | ◎ | ○ | ○ | ◎ |
| 66 | C | 1 | 3 | 750 | 60 | 7 | 20 | ◎ | ○ | ○ | ◎ |
| 67 | A | 1 | 3 | 750 | 90 | 7 | 20 | ◎ | ○ | ○ | ◎ |
| 68 | A | 1 | 3 | 750 | 120 | 7 | 20 | ◎ | ○ | ○ | ◎ |
| 69 | C | 1 | 0.1 | 600 | 20 | 7 | 20 | ◎ | ○ | ○ | ◎ |
| 70 | C | 1 | 0.3 | 750 | 90 | 7 | 20 | ◎ | ○ | ○ | ◎ |
| 71 | C | 1 | 3 | 800 | 60 | 7 | 20 | ◎ | ○ | ○ | ◎ |
| 72 | C | 1 | 3 | 850 | 60 | 7 | 20 | ◎ | ○ | ○ | ◎ |
| 73 | B | 1 | 3 | 600 | 10 | 9 | 5 | ◎ | ○ | ○ | ◎ |
| 74 | B | 1 | 3 | 650 | 10 | 9 | 5 | ◎ | ○ | ○ | ◎ |
| 75 | B | 1 | 3 | 700 | 10 | 9 | 5 | ◎ | ○ | ○ | ◎ |
| 76 | B | 1 | 3 | 750 | 10 | 9 | 5 | ◎ | ○ | ○ | ◎ |
| 77 | B | 1 | 3 | 600 | 25 | 5 | 25 | ◎ | ○ | ○ | ◎ |
| 78 | B | 1 | 3 | 650 | 25 | 5 | 30 | ◎ | ○ | ○ | ◎ |

TABLE 8

| No. | Base plate | Pre-coating condition: Type | Pre-coating condition: Coating weight (g/m²) | Diffusion condition: Maximum plate temperature (°C.) | Diffusion condition: Holding time (sec.) | Zinc electroplating condition: Type | Zinc electroplating condition: Coating weight (g/m²) | Corrosion resistance | Coating adhesiveness: Pre-coating | Coating adhesiveness: Zinc coating | Paintability | Remarks |
|---|---|---|---|---|---|---|---|---|---|---|---|---|
| 1 | A | 1 | 0.05 | 600 | 20 | 7 | 20 | Δ | ○ | ○ | Δ | |
| 2 | A | 1 | 9 | 750 | 5 | 7 | 20 | ◎ | ○ | ○ | ○ | High cost |
| 3 | A | 1 | 5 | 700 | 20 | 7 | 0.5 | Δ | ○ | ○ | Δ | |
| 4 | A | 1 | 5 | 700 | 20 | 7 | 35 | ◎ | ○ | X | ○ | |
| 5 | A | 1 | 3 | 770 | 60 | 24 | 20 | X | ○ | ○ | Δ | |
| 6 | A | 11 | 3 | 770 | 60 | 7 | 20 | Δ | ○ | ○ | Δ | |
| 7 | A | 12 | 3 | 770 | 60 | 7 | 20 | Δ | Δ | ○ | Δ | |
| 8 | A | 13 | 3 | 770 | 60 | 7 | 20 | Δ | ○ | ○ | Δ | |
| 9 | A | 14 | 3 | 770 | 60 | 7 | 20 | Δ | X | ○ | ○ | |
| 10 | A | 15 | 3 | 770 | 60 | 7 | 20 | Δ | X | ○ | ○ | |
| 11 | A | 16 | 3 | 770 | 60 | 7 | 20 | Δ | ○ | ○ | Δ | |
| 12 | B | 16 | 5 | 770 | 60 | 1 | 20 | Δ | ○ | ○ | Δ | |
| 13 | B | 16 | 3 | 770 | 60 | 1 | 20 | Δ | ○ | ○ | Δ | |
| 14 | C | 16 | 3 | 770 | 60 | 1 | 20 | Δ | ○ | ○ | Δ | |
| 15 | A | 17 | 3 | 770 | 60 | 7 | 20 | Δ | ○ | ○ | Δ | |
| 16 | A | 18 | 3 | 770 | 60 | 7 | 20 | Δ | X | ○ | Δ | |
| 17 | A | 19 | 3 | 770 | 60 | 7 | 20 | Δ | ○ | ○ | Δ | |

TABLE 8-continued

| | | Pre-coating condition | | Diffusion condition | | Zinc electroplating condition | | | Coating adhesiveness | | | |
|---|---|---|---|---|---|---|---|---|---|---|---|---|
| No. | Base plate | Type | Coating weight ($g/m^2$) | Maximum plate temperature (°C.) | Holding time (sec.) | Type | Coating weight ($g/m^2$) | Corrosion resistance | Pre-coating | Zinc coating | Paintability | Remarks |
| 18 | A | 20 | 3 | 770 | 60 | 7 | 20 | Δ | X | ○ | Δ | |
| 19 | A | None | 0 | 770 | 60 | 7 | 20 | Δ | | ○ | Δ | |
| 20 | A | None | 0 | 770 | 60 | 24 | 20 | Δ | | ○ | Δ | |
| 21 | B | None | 0 | 770 | 60 | 7 | 20 | Δ | | ○ | Δ | |
| 22 | D | None | 0 | 770 | 60 | 7 | 20 | ○ | | ○ | Δ | |
| 23 | D | None | 0 | 770 | 60 | 21 | 20 | Δ | | ○ | ○ | |
| 24 | E | None | 0 | 770 | 60 | 22 | 20 | Δ | | ○ | ○ | |
| 25 | F | None | 0 | 770 | 60 | 23 | 20 | Δ | | ○ | ○ | |
| 26 | C | None | 0 | 770 | 60 | 7 | 20 | X | | ○ | Δ | |
| 27 | A | 1 | 3 | 650 | 0.5 | 7 | 20 | Δ | ○ | ○ | Δ | |
| 28 | A | 1 | 3 | 650 | 130 | 7 | 20 | ○ | Δ | Δ | ○ | |
| 29 | B | 1 | 3 | 480 | 10 | 9 | 5 | Δ | ○ | Δ | Δ | |
| 30 | B | 1 | 3 | 860 | 10 | 9 | 5 | Δ | Δ | ○ | Δ | |
| 31 | B | 1 | 5 | 480 | 25 | 5 | 25 | Δ | ○ | Δ | ○ | |
| 32 | B | 1 | 5 | 870 | 25 | 5 | 25 | Δ | Δ | ○ | ○ | |

Embodiment 3

The steel sheets used in the present invention are hot-rolled steel sheets and the like including steel strips, and have their approximate thickness of 1.6 to 4.5 mm. In particular, the usefulness of the present invention effectively appears by employing a very low carbon steel sheet having good mechanical characteristics. In concrete terms, a very low carbon steel shows a very low content of solid solution C at a level of several tens of ppm and has a very high purity, so the corrosion resistance of that type of steel tends to be inferior to ordinary low carbon steels. Nevertheless, the method of the present invention compensates the disadvantage of a base plate and provides a steel sheet having both the good mechanical characteristics and the high corrosion resistance.

According to the present invention, a Ni—P alloy coating layer containing P of 8 to 15 wt. % is formed on a cold-rolled steel sheet. This is called the "pre-coating layer". The Ni—P alloy coating containing P 8 to 15 wt. % shows an amorphous-like structure. When a steel sheet having that type of coating layer is subjected to heat treatment, a uniform diffused alloy layer which is more uniform than general crystalline coating film is formed within a short period. The P content less than 8 wt. % gives a crystalline Ni—P alloy coating layer and results in a non-uniform distribution of P. As a result, a stable corrosion resistance can not be obtained because the composition of the diffused alloy layer formed in a heat treatment is not uniform and because the contribution to the densification of the rust generated in the base steel plate is not sufficient. Addition of above 15 wt. % P induces a brittle Ni—P alloy coating and results in a poor adhesiveness of the coating layer. Consequently, an excessive addition of P tends to separate the coating layer during heat treatment and other processing. Therefore, the content of P in the coating layer formed on the steel sheet of the present invention is specified in a range of from 8 to 15 wt. %. A more preferable P content is in a range of from 10 to 13 wt. %.

A steel sheet may be coated with a Ni—P alloy coating layer which is a composite of Ni—P combined with at least one element selected from the group of W, Mo, Cr, and Cu in an amount of 15 wt. % or less after the pickling stage. As for the role of W, Mo, Cr, and Cu, they play a role of inhibitor against the corrosion of steel and they also provide an effect to further improve the denseness and stability of the rust generated in the initial stage of corrosion process owing to the synergistic effect with Ni and P. The preferable content of W, Mo, Cr, and Cu is the sum of them at 15 wt. % or less. An increase of the content of W, Mo, Cr, and Cu improves the corrosion resistance. However, when the sum of the W, Mo, Cr and Cu content exceeds 15 wt. %, the adhesiveness of formed coating layer degrades, and the separation of coating layer tends to occur in the succeeding treatments such as cold-rolling. Therefore, a preferable content of the sum of W, Mo, Cr, and Cu is specified as 15 wt. % or less as the total amount of these elements. A preferable lower limit of content to perform the effect of W, Mo, Cr, and Cu is 0.5 wt. %.

The range of coating weight of the Ni—P alloy coating layer is not limitive, but a preferred range is from 0.5 to 8 $g/m^2$. If the coating weight is too small, the effect for improving the corrosion resistance is not sufficient, and if the coating weight is excessive, the performance improvement can not correspond to the cost increase, which is not efficient for practical point of view. There are several proposed methods for forming Ni—P alloy coating (pre-coating) layer. However, electroplating or electroless coating (chemical coating) is preferable from the stand point of simple operation and uniformity of obtained film quality. In the case of a wet coating method, the coating can be applied at the exit of the pickling stage following the pickling treatment. This treatment allows to form effectively a pre-coating film having a good adhesiveness without requiring a further cleaning stage for the hot-rolled steel sheet-which was pickled and activated. The steel sheet coated with Ni—P alloy layer undergoes cold rolling. The cold rolling condition such as reduction ratio is not specifically limitive. The reason why the pre-coating is carried out before the cold rolling is that the treatment line-up has an advantage that cleaning before the precoating and the pickling as the activation before coating are not required.

In the next step, the hot-rolled steel sheet is subjected to heat treatment in a non-oxidizing atmosphere to form a diffused alloy layer consisting mainly of Fe—Ni—P at the interface between the base steel sheet surface and the coating layer. The heat treatment for diffusion may be performed in an ordinary annealing facility following the cold-rolling process. At that treatment, a normal softening annealing may be applied to conduct the heat treatment at a time. A preferable maximum temperature of the steel sheet during the heat treatment is from 500° C. to 850° C. The temperature below 500° C. does not form a sufficient diffused layer between the "pre-coating layer" and the steel sheet surface, and gives less effect for improving the corrosion resistance because a stable initial stage rust can not be formed during the corrosion process. On the other hand, the temperature above 850° C. likely induces pickup of coating metal onto the rolls inside of the heat treatment furnace, and may cause surface flaws. The holding time at the maximum sheet temperature is preferably in a range of from 1 to 120 sec., though it depends on the temperature level. The holding time of less than 1 sec. hardly forms the sufficient diffused layer, and results in an insufficient-improvement of corrosion resistance. The holding time above 120 sec. tends to induce a brittle interface layer caused by an excessive diffusion alloying phenomenon, which may degrade the adhesiveness and workability of the coating layer. An overaging at an approximate temperature of 300° to 400° C. for several minutes may be applied during the heat treatment. The preferred depth of the diffused layer formed by the heat treatment is in a range of from 0.1 to 20 μm. When a Ni—P alloy coating layer undergoes heat treatment, two types of coating structure appear. One is that a part of the Ni—P alloy coating layer forms a diffused alloy layer and forms the steel sheet/diffused alloy layer/Ni—P alloy coating layer structure. The other is that all the Ni—P alloy coating layer forms a diffused alloy layer to give the steel sheet/diffused alloy layer structure. The present invention includes both cases. According to the present invention, a temper rolling is conducted after the heat treatment for diffusion under an appropriate condition, as needed.

The steel sheet that has undergone such a treatment is subjected to an electroplating in the electroplating line. An effective mode of the electroplating is the Zn electroplating having Zn as the matrix and containing at least one metal or oxide selected from the group of Ni, Fe, Co, Cr, Mn, Ti, Mo, Si, and Al in a form of alloy or of dispersed particles. That type of coating is inert for coating corrosion so that it contributes to the corrosion resistance during the coating corrosion process. At the same time, the synergistic effect of the components in the Zn matrix and the components existing in the diffusion layer, such as Ni, P, etc., gives an effect on the rust stabilization and densification of the rust in the base iron plate. Particularly, as for in the Zn—Cr coating, Cr in the coating film performs a synergistic effect with the components such as Ni and P in the diffusion treatment layer even after the disappearance of the coating, and the Zn—Cr coating is effective for stabilizing and densifying the Fe rust. Accordingly, the Zn—Cr coating gives particularly high corrosion resistance among the above discussed coatings.

A preferable zinc coating weight of zinc electroplating or zinc coating is in a range of from 10 to 50 g/m$^2$. Too small a coating weight can not give a sufficient corrosion resistance, and excessive coating weight degrades the workability of coating layer and increases the production cost. For a zinc electroplating bath, widely used sulfuric acid bath and chloride bath may be employed. For further improvement of corrosion resistance, a chromate treatment may be applied on the zinc electroplating layer, and further an organic composite resin coating may be applied. As for the chromate treatment, either one of the reaction type, the electrolysis type, and the application type is applicable. The chromate film may contain organic compounds such as acrylic resin, oxide colloid such as silica colloid and alumina colloid, acid such as molybdenum oxide, salt, or other anti-rusting improve agent. The organic resin film which coats the chromate film may use an epoxy resin as the base resin. The organic resin film preferably further contains a rust preventive additive such as silica and chromate at an approximate range of from 10 to 60 wt. %.

The zinc electroplating steel sheet prepared by the procedure described above has the diffused alloy layer consisting mainly of Fe—Ni—P formed by the mutual diffusion of the pre-coating layer of the surface of base steel sheet and the base steel sheet, and has the zinc coating or the zinc electroplating layer above the pre-coating layer. The zinc electroplating steel sheet of the present invention has an extremely high corrosion resistance compared with the zinc coated steel sheets obtained by conventional processes. The superiority presumably comes from the contribution of the diffused alloy layer consisting mainly of Fe—Ni—P existing at the interface between the zinc coating layer and the base steel sheet, as well as the high corrosion resistance of the zinc coating layer. Although the detailed mechanism of the improved corrosion resistance is not perfectly understood, the inventors assume a process where, during the progress of corrosion of the coated film to corrode the base steel sheet, the intermediate diffused alloy layer forms a uniform and dense Fe rust, which rust then suppresses the cathode reaction in the corrosion process.

On the other hand, the case of forming a zinc coating layer gives a better corrosion resistance than conventional products, though it gives somewhat lower corrosion resistance compared with the case of forming a zinc electroplating layer which is described above. In particular, since the zinc coating is relatively active, it is effective for the cases where a high corrosion resistance is requested under a condition which needs a sacrifice corrosion protection: for example, the steel sheet exposes by a defected painting or at an edge thereof. The highly active property of that type of product initiates the corrosion of the diffusion-treated layer on the base steel sheet compared with the zinc coating described above. However, the components such as Ni and P existing in the diffusion-treated layer contribute to the stabilization of Fe rust, so the progress of the corrosion reaches a saturation level. In other words, the application of zinc coating provides a steel sheet having high corrosion resistance over the whole corrosion process because the zinc coating layer plays an effective role during the initial stage of corrosion and the diffusion-treated layer plays an effective role during the latter half period of the corrosion process.

EXAMPLE 3

Hot-rolled steel sheets underwent pre-coating treatment to form Ni—P ahoy coating layer. The hot-rolled steel sheets coated with the Ni—P alloy layer were subjected to cold rolling at a reduction ratio of 75%. The cold-rolled steel sheets were subjected to heat treatment in a non-oxidizing atmosphere to form a diffused ahoy layer consisting mainly of Fe—Ni—P at the interface between the base steel sheet and the coating layer. The steel sheets were then treated by ordinary preliminary treatment before coating, followed by the zinc electroplating to form the zinc electroplating layer. Thus, the test pieces of the present invention were prepared. For comparison, the test pieces were prepared in a similar procedure of cold rolling, annealing, and coating except for pre-coating. Those test pieces were evaluated by the same method employed in Example 1.

Table 9 shows the thickness and composition of the hot-rolled steel sheets tested. The materials No. A and B of Table 9 are the low carbon steel of the Example of the present invention, the material No. C is the very low carbon steel of the Example of the present invention, and the materials No. D, E, and F are the high Cr steel, the high P steel, and the high Mo steel of the Comparative Examples.

Table 10 shows the condition of pre-coating. The composition of the coating solution is expressed by the unit of gram per liter. The conditions No. 1 through 10 are the pre-coating condition for the Examples of the present invention, and the conditions No. 11 through 16 are the pre-coating condition for the Comparative Examples. The conditions No. 8, 9, 10, and 15 are for the electroless coating. The coating solution contained a pH buffer agent such as boric acid and sodium citrate or a stabilizer. The coating weight was adjusted by changing the current density and the coating time.

Table 11 lists the conditions of zinc electroplating. The coating solution contained a conductive assistant such as sodium sulfate, a pH buffer agent such as sodium citrate, a brightening agent, and a deposition assistant, at need. The coating weight was adjusted by changing the current density and the coating time.

Table 12 (A) to (E) show the evaluation of each kind of performance based on the same criterion applied in Example 1.

Table 13 shows the evaluation of each kind of performance in Comparative Examples.

As these examples clearly show, according to the present invention, a zinc coated steel sheet having a good corrosion resistance with less coating weight is effectively produced. The method of the present invention significantly improves the corrosion resistance by adding a small amount of corrosion-resistance-improving component to the interface between the coating layer and the steel sheet without adding a large amount of that type of component to the whole area of the steel sheet. The method gives a substantial merit to the production cost of the steel sheets. In addition, these Examples show that the steel sheets prepared by the method of the present invention has better corrosion resistance than the conventional anti-corrosive steel sheets (high P, with addition of Cr and Mo) coated with Zn layer (Comparative Examples 13, 14, 15, and 16). The presumable cause of the advantage is that the interface diffusion layer formed by the "precoating," Ni—P alloy coating, is superior to the coating of conventional methods in terms of forming a stable and dense rust during the initial stage of corrosion process. In addition, the mode of the present invention provided better workability of coating layer than conventional methods. The reason of the good workability of coating layer is presumably the effect of Ni to enhance the uniform reaction between copper and zinc to form an alloy layer having a good adhesiveness.

According to the present invention, the diffused alloy layer appeared at the interface between the zinc coating layer and the base steel sheet forms a uniform and dense Fe rust. As a result, the steel sheet of the present invention provides a high corrosion resistance with less coating weight without limitation of the component content in the base steel sheet even under a severe environmental condition which an automobile rust preventive steel sheet encounters.

TABLE 9

| | Plate thickness | C | Si | Mn | P | S | Al | Cu | Cr | Mo | Ti |
|---|---|---|---|---|---|---|---|---|---|---|---|
| A | 2.8 mm | 0.06 | 0.02 | 0.5 | 0.03 | 0.002 | 0.03 | — | — | — | — |
| B | 2.8 mm | 0.05 | 0.04 | 1.2 | 0.05 | 0.002 | 0.05 | — | — | — | — |
| C | 2.8 mm | 0.002 | 0.01 | 0.2 | 0.08 | 0.003 | 0.06 | — | — | — | 0.11 |
| D | 2.8 mm | 0.02 | 0.01 | 0.2 | 0.03 | 0.012 | 0.04 | 0.03 | 0.8 | — | — |
| E | 2.8 mm | 0.01 | 0.01 | 0.2 | 0.1 | 0.012 | 0.04 | 0.1 | — | — | — |
| F | 2.8 mm | 0.05 | 0.01 | 0.3 | 0.02 | 0.012 | 0.04 | 0.01 | 1.0 | 0.3 | — |

TABLE 10

| Coating layer composition (wt. %) | Nickel sulfate | Phosphorous acid | Chromium sulfate | Copper sulfate | Sodium molybdate | Sodium tungstate |
|---|---|---|---|---|---|---|
| 1 Ni-11% P | 250 | 30 | — | — | — | — |
| 2 Ni-14% P | 250 | 50 | — | — | — | — |
| 3 Ni-11% P-3% Cr | 250 | 35 | 50 | — | — | — |
| 4 Ni-11% P-12% Cr | 250 | 35 | 150 | — | — | — |
| 5 Ni-15% P-1% Mo | 250 | 50 | — | — | 40 | — |
| 6 Ni-15% P-8% Mo | 250 | 50 | — | — | 100 | — |
| 7 Ni-11% P-5% Cr-1% Mo | 250 | 35 | 70 | — | 30 | — |
| 8 Ni-12% P | 30 | 30 (hypophosphorous acid) | | — | — | — |
| 9 Ni-11% P-12% W | 30 | 30 (hypophosphorous acid) | | — | — | 60 |
| 10 Ni-10% P-15% Cu | 250 | 30 (hypophosphorous acid) | | 3 | — | — |
| 11 Ni-7% P | 250 | 20 | — | — | — | — |
| 12 Ni-16% P | 250 | 60 | — | — | — | — |
| 13 Ni-5% P-10% Cr | 250 | 15 | | — | — | — |
| 14 Ni-10% P-16% Mo | 250 | 35 | — | — | 150 | — |
| 15 Ni-11% P-16% W | 30 | 30 | | — | — | 100 |

TABLE 10-continued

| Coating layer composition (wt. %) | Nickel sulfate | Phosphorous acid | Chromium sulfate | Copper sulfate | Sodium molybdate | Sodium tungstate |
|---|---|---|---|---|---|---|
| | | (hypophosphorous acid) | | | | |
| 16 Ni | 250 | — | — | — | — | — |

TABLE 11

| Coating layer composition (wt. %) | Coating solution composition (g/l) | | | | | | | | | |
|---|---|---|---|---|---|---|---|---|---|---|
| | Zinc sulfate | Nickel sulfate | Ferrous sulfate | Chromium sulfate | Cobalt sulfate | Titanium sulfate | Sodium molybdate | Manganese sulfate | Alumina sol | Colloidal silica |
| 1 Zn-12% Ni | 150 | 350 | | | | | | | | |
| 2 Zn-11% Ni-2% Cr | 150 | 350 | | 50 | | | | | | |
| 3 Zn-13% Fe | 200 | | 300 | | | | | | | |
| 4 Zn-2% Cr | 250 | | | 400 | | | | | | |
| 5 Zn-4% Cr | 250 | | | 400 | | | | | | |
| 6 Zn-1% Cr oxide | 300 | | | 50 | | | | | | |
| 7 Zn-12% Cr | 250 | | | 400 | | | | | | |
| 8 Zn-32% Cr | 150 | | | 500 | | | | | | |
| 9 Zn-2% Cr-1% Co | 250 | | | 400 | | | | | | |
| 10 Zn-2% Cr-1% Ni | 240 | 180 | | 70 | | | | | | |
| 11 Zn-12% Cr-1% Co | 240 | | | 200 | 50 | | | | | |
| 12 Zn-12% Cr-1% Ni | 240 | 180 | | 200 | | | | | | |
| 13 Zn-2% Si oxide | 300 | | | | | | | | | 70 |
| 14 Zn-5% Si oxide | 300 | | | | | | | | | 70 |
| 15 Zn-60% Mn | 50 | | | | | | | 450 | | |
| 16 Zn-55% Mn-4% Cr | 50 | | | 100 | | | | 450 | | |
| 17 Zn-12% Cr-1% Mo | 250 | | | 400 | | | 50 | | | |
| 18 Zn-12% Cr-1% Ti | 250 | | | 400 | | 100 | | | | |
| 19 Zn-2% Ti oxide | 300 | | | | | 150 | | | | |
| 20 Zn-1% Si oxide-1% Cr oxide | 350 | | | | | 150 | 100 | | | |
| 21 Zn-14% Ni | 150 | 350 | | | | | | | | |
| 22 Zn-16% Ni | 100 | 400 | | | | | | | | |
| 23 Zn-15% Fe-1% Cr | 200 | | 300 | 150 | | | | | | |
| 24 Zn-2% Co-1% Cr-2% Al oxide | 350 | | | 100 | 100 | | | | 10 | |
| 25 Zn | 400 | | | | | | | | | |

TABLE 12

| | | Pre-coating condition | | Diffusion condition | | Zinc electroplating condition | | | Coating adhesiveness | | |
|---|---|---|---|---|---|---|---|---|---|---|---|
| No. | Base plate | Type | Coating weight ($g/m^2$) | Maximum plate temperature (°C.) | Holding time (sec.) | Type | Coating weight ($g/m^2$) | Corrosion resistance | Pre-coating | Zinc coating | Paintability |
| 1 | A | 1 | 0.5 | 600 | 20 | 7 | 20 | ◎ | ○ | ○ | ◎ |
| 2 | A | 1 | 3 | 500 | 10 | 7 | 20 | ◎ | ○ | ○ | ◎ |
| 3 | A | 1 | 3 | 700 | 25 | 7 | 20 | ◎ | ○ | ○ | ◎ |
| 4 | A | 1 | 3 | 820 | 10 | 7 | 20 | ◎ | ○ | ○ | ◎ |
| 5 | A | 1 | 5 | 600 | 20 | 7 | 20 | ◎ | ○ | ○ | ◎ |
| 6 | A | 1 | 7 | 650 | 10 | 7 | 20 | ◎ | ○ | ○ | ◎ |
| 7 | A | 1 | 8 | 750 | 5 | 7 | 20 | ◎ | ○ | ○ | ◎ |
| 8 | A | 1 | 6 | 850 | 1 | 7 | 20 | ◎ | ○ | ○ | ◎ |
| 9 | A | 1 | 5 | 770 | 20 | 7 | 10 | ◎ | ○ | ○ | ◎ |
| 10 | A | 1 | 5 | 770 | 20 | 7 | 15 | ◎ | ○ | ○ | ◎ |
| 11 | A | 1 | 5 | 770 | 20 | 7 | 35 | ◎ | ○ | ○ | ◎ |
| 12 | A | 1 | 5 | 770 | 20 | 7 | 40 | ◎ | ○ | ○ | ◎ |
| 13 | A | 1 | 5 | 770 | 60 | 1 | 20 | ○ | ○ | ○ | ◎ |
| 14 | A | 1 | 5 | 770 | 60 | 2 | 20 | ○ | ○ | ○ | ◎ |
| 15 | A | 1 | 5 | 770 | 60 | 3 | 20 | ○ | ○ | ○ | ◎ |
| 16 | A | 1 | 5 | 770 | 60 | 4 | 20 | ◎ | ○ | ○ | ◎ |
| 17 | A | 1 | 5 | 770 | 60 | 5 | 20 | ◎ | ○ | ○ | ◎ |
| 18 | A | 1 | 5 | 770 | 60 | 6 | 20 | ◎ | ○ | ○ | ◎ |
| 19 | A | 1 | 5 | 770 | 60 | 7 | 20 | ◎ | ○ | ○ | ◎ |
| 20 | A | 1 | 3 | 770 | 60 | 9 | 20 | ◎ | ○ | ○ | ◎ |
| 21 | A | 1 | 3 | 770 | 60 | 10 | 20 | ◎ | ○ | ○ | ◎ |
| 22 | A | 1 | 3 | 770 | 60 | 11 | 20 | ◎ | ○ | ○ | ◎ |

TABLE 12-continued

| No. | Base plate | Pre-coating condition: Type | Pre-coating condition: Coating weight (g/m²) | Diffusion condition: Maximum plate temperature (°C.) | Diffusion condition: Holding time (sec.) | Zinc electroplating condition: Type | Zinc electroplating condition: Coating weight (g/m²) | Corrosion resistance | Coating adhesiveness: Pre-coating | Coating adhesiveness: Zinc coating | Paintability |
|---|---|---|---|---|---|---|---|---|---|---|---|
| 23 | A | 1 | 3 | 770 | 60 | 12 | 20 | ◎ | ○ | ○ | ◎ |
| 24 | A | 1 | 3 | 770 | 60 | 13 | 20 | ◎ | ○ | ○ | ◎ |
| 25 | A | 1 | 3 | 770 | 60 | 14 | 20 | ◎ | ○ | ○ | ◎ |
| 26 | A | 1 | 3 | 770 | 60 | 15 | 20 | ◎ | ○ | ○ | ◎ |
| 27 | A | 1 | 3 | 770 | 60 | 16 | 20 | ◎ | ○ | ○ | ◎ |
| 28 | A | 1 | 3 | 770 | 60 | 17 | 20 | ◎ | ○ | ○ | ◎ |
| 29 | A | 1 | 3 | 770 | 60 | 18 | 20 | ◎ | ○ | ○ | ◎ |
| 30 | A | 1 | 3 | 770 | 60 | 19 | 20 | ◎ | ○ | ○ | ◎ |
| 31 | A | 1 | 3 | 770 | 60 | 20 | 20 | ◎ | ○ | ○ | ◎ |
| 32 | A | 1 | 3 | 770 | 60 | 21 | 20 | ◎ | ○ | ○ | ◎ |
| 33 | A | 1 | 3 | 770 | 60 | 22 | 20 | ◎ | ○ | ○ | ◎ |
| 34 | A | 1 | 3 | 770 | 60 | 23 | 20 | ◎ | ○ | ○ | ◎ |
| 35 | A | 1 | 3 | 770 | 60 | 24 | 20 | ◎ | ○ | ○ | ◎ |
| 36 | A | 1 | 3 | 770 | 60 | 25 | 20 | ◎ | ○ | ○ | ◎ |
| 37 | A | 2 | 3 | 770 | 60 | 7 | 20 | ◎ | ○ | ○ | ◎ |
| 38 | A | 2 | 3 | 770 | 60 | 9 | 20 | ◎ | ○ | ○ | ◎ |
| 39 | A | 2 | 3 | 770 | 60 | 14 | 20 | ◎ | ○ | ○ | ◎ |
| 40 | A | 3 | 3 | 770 | 60 | 7 | 20 | ◎ | ○ | ○ | ◎ |
| 41 | A | 3 | 3 | 770 | 60 | 9 | 20 | ◎ | ○ | ○ | ◎ |
| 42 | A | 3 | 3 | 770 | 60 | 14 | 20 | ◎ | ○ | ○ | ◎ |
| 43 | A | 4 | 3 | 770 | 60 | 7 | 20 | ◎ | ○ | ○ | ◎ |
| 44 | A | 4 | 3 | 770 | 60 | 9 | 20 | ◎ | ○ | ○ | ◎ |
| 45 | A | 4 | 3 | 770 | 60 | 14 | 20 | ◎ | ○ | ○ | ◎ |
| 46 | A | 5 | 3 | 770 | 60 | 7 | 20 | ◎ | ○ | ○ | ◎ |
| 47 | A | 5 | 3 | 770 | 60 | 9 | 20 | ◎ | ○ | ○ | ◎ |
| 48 | A | 5 | 3 | 770 | 60 | 14 | 20 | ◎ | ○ | ○ | ◎ |
| 49 | A | 6 | 3 | 770 | 60 | 7 | 20 | ◎ | ○ | ○ | ◎ |
| 50 | A | 6 | 3 | 770 | 60 | 9 | 20 | ◎ | ○ | ○ | ◎ |
| 51 | A | 6 | 3 | 770 | 60 | 14 | 20 | ◎ | ○ | ○ | ◎ |
| 52 | A | 7 | 3 | 770 | 60 | 7 | 20 | ◎ | ○ | ○ | ◎ |
| 53 | A | 7 | 3 | 770 | 60 | 9 | 20 | ◎ | ○ | ○ | ◎ |
| 54 | A | 7 | 3 | 770 | 60 | 17 | 20 | ◎ | ○ | ○ | ◎ |
| 55 | A | 8 | 3 | 770 | 60 | 7 | 20 | ◎ | ○ | ○ | ◎ |
| 56 | A | 8 | 3 | 770 | 60 | 9 | 20 | ◎ | ○ | ○ | ◎ |
| 57 | A | 8 | 3 | 770 | 60 | 14 | 20 | ◎ | ○ | ○ | ◎ |
| 58 | A | 9 | 3 | 770 | 60 | 7 | 20 | ◎ | ○ | ○ | ◎ |
| 59 | A | 9 | 3 | 770 | 60 | 9 | 20 | ◎ | ○ | ○ | ◎ |
| 60 | A | 9 | 3 | 770 | 60 | 14 | 20 | ◎ | ○ | ○ | ◎ |
| 61 | A | 10 | 3 | 770 | 60 | 7 | 20 | ◎ | ○ | ○ | ◎ |
| 62 | A | 10 | 3 | 770 | 60 | 9 | 20 | ◎ | ○ | ○ | ◎ |
| 63 | A | 10 | 3 | 550 | 10 | 14 | 20 | ◎ | ○ | ○ | ◎ |
| 64 | A | 1 | 3 | 750 | 1 | 7 | 20 | ◎ | ○ | ○ | ◎ |
| 65 | A | 1 | 3 | 750 | 5 | 7 | 20 | ◎ | ○ | ○ | ◎ |
| 66 | C | 1 | 3 | 750 | 60 | 7 | 20 | ◎ | ○ | ○ | ◎ |
| 67 | A | 1 | 3 | 750 | 90 | 7 | 20 | ◎ | ○ | ○ | ◎ |
| 68 | A | 1 | 3 | 750 | 120 | 7 | 20 | ◎ | ○ | ○ | ◎ |
| 69 | C | 1 | 0.5 | 600 | 20 | 7 | 20 | ◎ | ○ | ○ | ◎ |
| 70 | C | 1 | 3 | 750 | 90 | 7 | 20 | ◎ | ○ | ○ | ◎ |
| 71 | C | 1 | 3 | 800 | 60 | 7 | 20 | ◎ | ○ | ○ | ◎ |
| 72 | C | 1 | 3 | 850 | 60 | 7 | 20 | ◎ | ○ | ○ | ◎ |
| 73 | B | 1 | 3 | 600 | 10 | 9 | 15 | ◎ | ○ | ○ | ◎ |
| 74 | B | 1 | 3 | 650 | 10 | 9 | 15 | ◎ | ○ | ○ | ◎ |
| 75 | B | 1 | 3 | 700 | 10 | 9 | 15 | ◎ | ○ | ○ | ◎ |
| 76 | B | 1 | 3 | 750 | 10 | 9 | 15 | ◎ | ○ | ○ | ◎ |
| 77 | B | 1 | 3 | 600 | 25 | 5 | 45 | ◎ | ○ | ○ | ◎ |
| 78 | B | 1 | 3 | 650 | 25 | 5 | 50 | ◎ | ○ | ○ | ◎ |

TABLE 13

| No. | Base plate | Pre-coating condition: Type | Pre-coating condition: Coating weight (g/m²) | Diffusion condition: Maximum plate temperature (°C.) | Diffusion condition: Holding time (sec.) | Zinc electroplating condition: Type | Zinc electroplating condition: Coating weight (g/m²) | Corrosion resistance | Coating adhesiveness: Pre-coating | Coating adhesiveness: Zinc coating | Paintability | Remarks |
|---|---|---|---|---|---|---|---|---|---|---|---|---|
| 1 | A | 11 | 3 | 770 | 60 | 7 | 20 | Δ | ○ | ○ | Δ | |
| 2 | A | 12 | 3 | 770 | 60 | 7 | 20 | Δ | Δ | ○ | Δ | |

TABLE 13-continued

| | | Pre-coating condition | | Diffusion condition | | Zinc electroplating condition | | | Coating adhesiveness | | | |
|---|---|---|---|---|---|---|---|---|---|---|---|---|
| No. | Base plate | Type | Coating weight (g/m²) | Maximum plate temperature (°C.) | Holding time (sec.) | Type | Coating weight (g/m²) | Corrosion resistance | Pre-coating | Zinc coating | Paintability | Remarks |
| 3 | A | 13 | 3 | 770 | 60 | 7 | 20 | Δ | ○ | ○ | Δ | |
| 4 | A | 14 | 3 | 770 | 60 | 7 | 20 | Δ | X | ○ | ○ | |
| 5 | A | 15 | 3 | 770 | 60 | 7 | 20 | Δ | X | ○ | ○ | |
| 6 | A | 16 | 3 | 770 | 60 | 7 | 20 | Δ | ○ | ○ | Δ | |
| 7 | B | 16 | 5 | 770 | 60 | 1 | 20 | Δ | ○ | ○ | Δ | |
| 8 | B | 16 | 3 | 770 | 60 | 1 | 20 | Δ | ○ | ○ | Δ | |
| 9 | C | 16 | 3 | 770 | 60 | 1 | 20 | Δ | ○ | ○ | Δ | |
| 10 | A | None | 0 | 770 | 60 | 7 | 20 | Δ | | ○ | Δ | |
| 11 | A | None | 0 | 770 | 60 | 24 | 20 | Δ | | ○ | Δ | |
| 12 | B | None | 0 | 770 | 60 | 7 | 20 | Δ | | ○ | Δ | |
| 13 | D | None | 0 | 770 | 60 | 7 | 20 | ○ | | ○ | Δ | |
| 14 | D | None | 0 | 770 | 60 | 21 | 20 | Δ | | ○ | ○ | |
| 15 | E | None | 0 | 770 | 60 | 22 | 20 | Δ | | ○ | ○ | |
| 16 | F | None | 0 | 770 | 60 | 23 | 20 | Δ | | ○ | ○ | |
| 17 | C | None | 0 | 770 | 60 | 7 | 20 | X | | ○ | Δ | |

What is claimed is:

1. A method for producing a zinc coated steel sheet, comprising the steps of:

forming a Ni—P alloy coating layer containing P of 8 to 15 wt. % on at least one surface of a steel sheet;

heat-treating the steel sheet coated with the alloy coating layer in a non-oxidizing atmosphere at a maximum temperature of 500° to 800° C. and a holding time of 1 to 30 seconds to form an Fe—Ni—P diffused alloy layer at an interface of the steel sheet and the alloy coating layer; and hot-dip galvanizing the steel sheet coated with the diffused alloy layer to form a hot dip galvanized coating layer.

2. The method of claim 1, wherein the Ni—P alloy coating layer contains P of 10 to 13 wt. %.

3. The method of claim 1, wherein the step of forming the alloy coating layer comprises forming a Ni—P alloy coating layer containing P of 8 to 15 wt. % and at least one element selected from the group consisting of W, Mo, Cr, and Cu in an amount of 15 wt. %.

4. The method of claim 3, wherein the alloy coating layer contains Ni, P, and Cr.

5. The method of claim 3, wherein the alloy coating layer contains Ni, P, and Mo.

6. The method of claim 3, wherein the alloy coating layer contains Ni, P, Cr, and Mo.

7. The method of claim 3, wherein the alloy coating layer contains Ni, P, and W.

8. The method of claim 3, wherein the alloy coating layer contains Ni, P, and Cu.

9. The method of claim 1, wherein the Ni—P alloy coating layer has a coating weight of 0.5 to 8 g/m$^2$.

10. The method of claim 1, wherein the Ni—P alloy coating layer is formed by electroplating.

11. The method of claim 1, wherein the Ni—P alloy coating layer is formed by electroless coating.

12. The method of claim 1, further comprising the step of heating the steel sheet coated with the hot dip galvanized layer to alloy the coating layer.

13. The method of claim 1, wherein the diffused alloy layer has a depth of 0.1 to 20 μm.

14. The method of claim 1, wherein the hot dip galvanized coating layer has a coating weight of 20 to 120 g/m$^2$.

15. A method for producing a zinc coated steel sheet, comprising the steps of:

forming a Ni—P alloy coating layer containing P of 8 to 15 wt. % on at least one surface of a steel sheet;

heat-treating the steel sheet coated with the alloy layer in a non-oxidizing atmosphere at a maximum temperature of 500° to 800° C. and a holding time of 1 to 120 seconds to form an Fe—Ni—P diffused alloy layer at an interface of the steel sheet and the alloy coating layer; and zinc-electroplating the steel sheet coated with the diffused alloy layer to form a zinc electroplated layer.

16. The method of claim 15, wherein the step of forming the alloy coating layer comprises forming a Ni—P alloy coating layer containing P of 8 to 15 wt. % and at least one element selected from the group consisting of W, Mo, and Cu in an amount of up to 15 wt. %.

17. The method of claim 16, wherein the alloy coating layer contains Ni, P, and Cu.

18. The method of claim 16, wherein the alloy coating layer contains Ni, P, and Mo.

19. The method of claim 16, wherein the alloy coating layer contains Ni, P, and W.

20. The method of claim 15, wherein the zinc electroplated layer has Zn as a matrix and contains at least one metal selected from the group consisting of Ni, Fe, Co, Cr, Mn, Ti, Mo, Si, and Al in a form of alloy.

21. The method of claim 20, wherein the zinc electroplated layer contains Zn and Ni.

22. The method of claim 20, wherein the zinc electroplated layer contains Zn and Fe.

23. The method of claim 20, wherein the zinc electroplated layer contains Zn and Cr.

24. The method of claim 20, wherein the zinc electroplating layer contains Zn and Mn.

25. The method of claim 15, wherein the zinc electroplating layer has Zn as a matrix and contains at least one oxide of the element selected from the group consisting of Ni, Fe, Co, Cr, Mn, Ti, Mo, Si, and Al in a form of dispersed particles.

26. The method of claim 25, wherein the zinc electroplating layer contains Zn and Cr oxide.

27. The method of claim 25, wherein the zinc electroplating layer contains Zn and Si oxide.

28. The method of claim 25, wherein the zinc electroplating layer contains Zn and Ti oxide.

29. The method of claim 15, wherein the Ni—P alloy coating layer contains P of 10 to 13 wt. %.

30. The method of claim 15, wherein the Ni—P alloy coating layer has a coating weight of 0.1 to 8 g/m$^2$.

31. The method of claim 15, wherein the Ni—P alloy coating layer is formed by electroplating.

32. The method of claim 15, wherein the Ni—P alloy coating layer is formed by electroless coating.

33. The method of claim 15, wherein the diffused alloy layer has a depth of 0.1 to 20 μm.

34. The method of claim 15, wherein the zinc electroplating layer has a coating weight of 1 to 30 g/m$^2$.

35. A method for producing a zinc coated steel sheet, comprising the steps of:

forming a Ni—P alloy coating layer containing P of 8 to 15 wt. % on at least one surface of a steel sheet;

cold-rolling the steel sheet coated with the alloy coating layer;

heat-treating the cold-rolled steel sheet in a non-oxidizing atmosphere at a maximum temperature of 500° to 850° C. and a holding time of 1 to 120 seconds to form an Fe—Ni—P diffused alloy layer at an interface of the steel sheet and the alloy coating layer; and zinc-coating the steel sheet coated with the diffused alloy layer to form a zinc coating layer.

36. The method of claim 35, wherein the Ni—P alloy coating layer contains P of 10 to 13 wt. %.

37. The method of claim 35, wherein the step of forming the alloy coating layer comprises forming a Ni—P alloy coating layer containing P of 8 to 15 wt. % and at least one element selected from the group consisting of W, Mo, Cr, and Cu in an amount of 15 wt. % or less.

38. The method of claim 37, wherein the alloy coating layer contains Ni, P, and Cr.

39. The method of claim 37, wherein the alloy coating layer contains Ni, P, and Mo.

40. The method of claim 37, wherein the alloy coating layer contains Ni, P, Cr, and Mo.

41. The method of claim 37, wherein the alloy coating layer contains Ni, P, and W.

42. The method of claim 37, wherein the alloy coating layer contains Ni, P, and Cu.

43. The method of claim 37, wherein the Ni—P alloy coating layer has a coating weight of 0.5 to 8 g/m.

44. The method of claim 35, wherein the Ni—P alloy coating layer is formed by electroplating.

45. The method of claim 35, wherein the Ni—P alloy coating layer is formed by electroless coating.

46. The method of claim 35, wherein the diffused alloy layer has a depth of 0.1 to 20 μm.

47. The method of claim 35, wherein the zinc coating layer is a zinc electroplating layer and the zinc coating layer has Zn as a matrix and contains at least one metal selected from the group consisting of Ni, Fe, Co, Cr, Mn, Ti, Mo, Si, and Al in a form of alloy.

48. The method of claim 47, wherein the zinc electroplating layer contains Zn and Ni.

49. The method of claim 47, wherein the zinc electroplating layer contains Zn and Fe.

50. The method of claim 47, wherein the zinc electroplating layer contains Zn and Cr.

51. The method of claim 47, wherein the zinc electroplating layer contains of Zn and Mn.

52. The method of claim 35, wherein the zinc coating layer is a zinc electroplating layer and the zinc coating layer has Zn as a matrix and contains at least one oxide of the element selected from the group consisting of Ni, Fe, Co, Cr, Mn, Ti, Mo, Si, and Al in a form of dispersed particles.

53. The method of claim 52, wherein the zinc electroplating layer contains Zn and Cr oxide.

54. The method of claim 52, wherein the zinc electroplating layer contains Zn and Si oxide.

55. The method of claim 52, wherein the zinc electroplating layer contains Zn and Ti oxide.

56. The method of claim 35, wherein the zinc coating layer has a coating weight of 10 to 50 g/m$^2$.

* * * * *